US009555288B1

(12) United States Patent
Lucas

(10) Patent No.: US 9,555,288 B1
(45) Date of Patent: Jan. 31, 2017

(54) BATH AND SWIM CAP WITH A SEAMLESS ELEMENT

(71) Applicant: Allison Lucas, Berkeley, CA (US)

(72) Inventor: Allison Lucas, Berkeley, CA (US)

( * ) Notice: Subject to any disclaimer, the term of this patent is extended or adjusted under 35 U.S.C. 154(b) by 0 days.

(21) Appl. No.: 14/566,213

(22) Filed: Dec. 10, 2014

(51) Int. Cl.

| | |
|---|---|
| ***A42B 1/12*** | (2006.01) |
| ***A63B 33/00*** | (2006.01) |
| ***A42B 1/00*** | (2006.01) |
| *A63B 71/10* | (2006.01) |

(52) U.S. Cl.
CPC ..... *A63B 33/00* (2013.01); *A42B 1/004* (2013.01)

(58) Field of Classification Search
CPC ..... A42B 1/12; A41G 5/0093; A61K 8/24; A61Q 17/04; A63B 2208/12; A63B 31/08; A63B 33/00; Y10S 2/909
See application file for complete search history.

(56) References Cited

U.S. PATENT DOCUMENTS

| | | | | |
|---|---|---|---|---|
| 1,874,879 | A * | 8/1932 | Brosch | A42B 1/12 2/195.7 |
| 2,286,652 | A * | 6/1942 | Sheffield | A42B 1/12 2/68 |
| 2,417,323 | A | 3/1947 | Richards et al. | |
| 2,705,802 | A | 4/1955 | Tellier | |
| 3,019,444 | A | 2/1962 | Pollock et al. | |
| 3,163,866 | A | 1/1965 | Denmark | |
| 3,234,563 | A | 2/1966 | Tabbat | |
| 3,247,521 | A | 4/1966 | Owen | |
| 3,321,772 | A | 5/1967 | Arps et al. | |
| 3,755,819 | A * | 9/1973 | Douglas | B63C 11/12 2/428 |
| 3,852,823 | A | 12/1974 | Jones | |
| 4,400,830 | A | 8/1983 | Gaitan | |
| D343,283 | S | 1/1994 | Sommers | |
| 5,349,702 | A | 9/1994 | Runckel | |
| 5,455,970 | A | 10/1995 | Vance et al. | |
| 5,855,026 | A | 1/1999 | Viola | |
| D448,917 | S | 10/2001 | Grant | |
| 6,309,270 | B1 * | 10/2001 | Harwell, IV | A63B 31/08 2/428 |
| 6,330,721 | B1 | 12/2001 | Wallace et al. | |
| 6,738,986 | B1 | 5/2004 | Martin | |
| 6,820,283 | B2 | 11/2004 | Graneto, III | |
| 6,966,068 | B2 | 11/2005 | Johnson et al. | |
| 7,827,621 | B2 | 11/2010 | DaCruz | |
| 2002/0083512 | A1 * | 7/2002 | Tsujino | A63B 71/10 2/423 |

(Continued)

*Primary Examiner* — Bobby Muromoto, Jr.
(74) *Attorney, Agent, or Firm* — Fernandez & Associates, LLP

(57) ABSTRACT

A water-resistant cap by which, in use, can be secured in a stretched manner tightly around a user's head with maximal comfort during swimming and bathing, including (1) a dome-shaped main body enclosure with a crown providing ample housing to fit hair of any size, (2) the crown projecting downward to a perimeter edge extending about an aperture—with a front-edge section, right-edge section, left-edge section, and a rear-edge section—forming a comfortable, water-tight seal during swimming or bathing; and (3) an element projecting from an outer-surface of the dome-shaped main body enclosure in a seamless fashion; and a method of economically manufacturing such cap with a seamless element.

10 Claims, 5 Drawing Sheets

(56) References Cited

U.S. PATENT DOCUMENTS

| | | | | |
|---|---|---|---|---|
| 2004/0157527 | A1* | 8/2004 | Omar | G05B 19/4207 446/268 |
| 2008/0010727 | A1* | 1/2008 | Keen | A63B 71/10 2/425 |
| 2008/0134405 | A1* | 6/2008 | Smith | A42B 1/12 2/68 |
| 2009/0139004 | A1* | 6/2009 | Vall | A42B 1/12 2/68 |
| 2011/0280943 | A1* | 11/2011 | Mansouri | A61K 8/0279 424/489 |
| 2011/0296595 | A1* | 12/2011 | Lukens | A63B 71/10 2/423 |
| 2012/0041086 | A1* | 2/2012 | Sampath | C08J 9/0038 521/59 |
| 2012/0063952 | A1* | 3/2012 | Hong | H01L 31/049 422/24 |
| 2012/0077898 | A1* | 3/2012 | Jacob | C08L 23/145 522/110 |
| 2012/0082834 | A1* | 4/2012 | Wermter | C08K 5/0008 428/220 |
| 2013/0152274 | A1 | 6/2013 | Welch | |
| 2013/0247269 | A1 | 9/2013 | Alburg | |

* cited by examiner

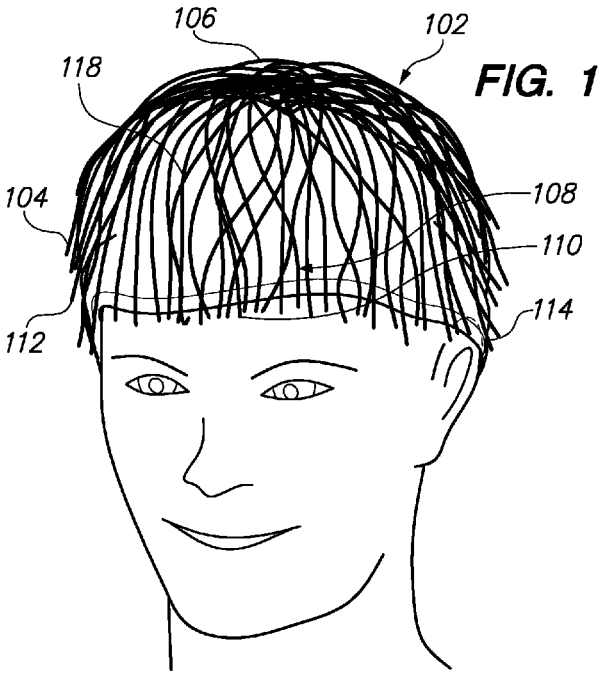
FIG. 1
FIG. 2
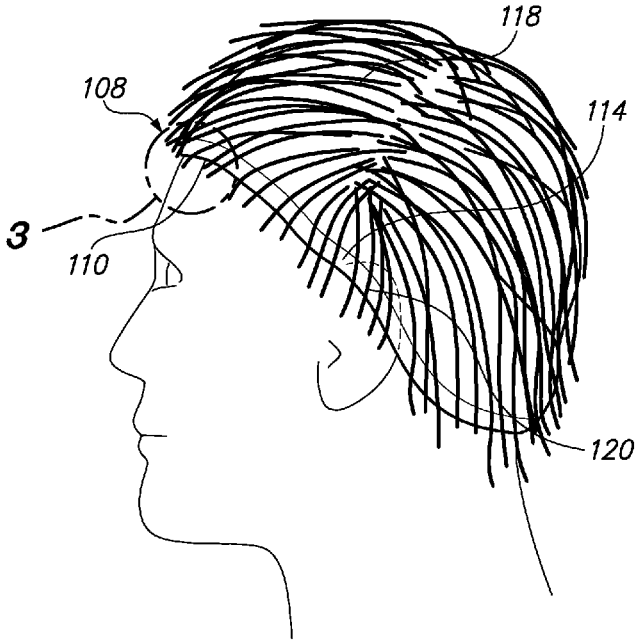

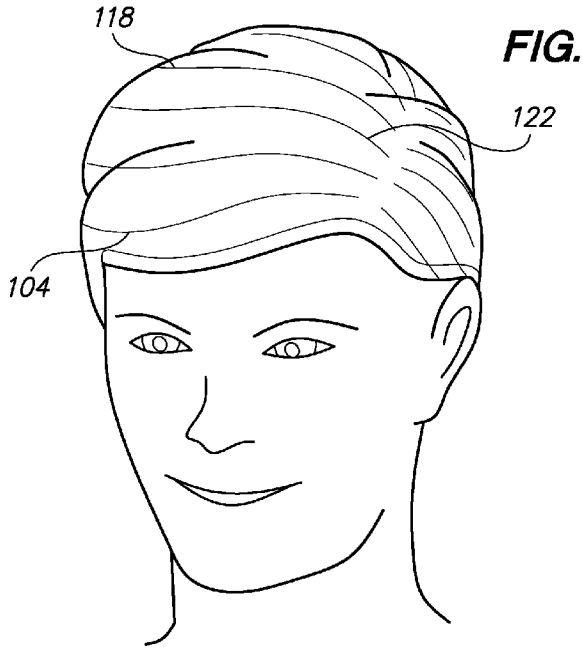
FIG. 4
FIG. 5
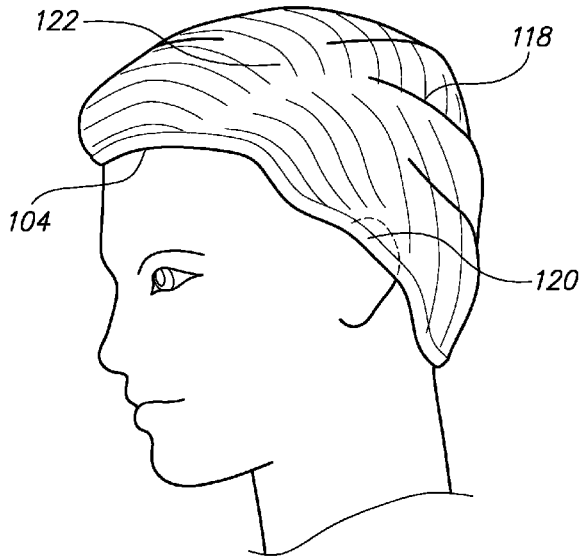

BATH AND SWIM CAP WITH A SEAMLESS ELEMENT

FIELD OF THE INVENTION

The present invention relates to a swim cap, more particularly, to a swim cap for effectively preventing water from contacting a swimmers or bathers hair during swimming or bathing, all the while making a style statement with a seamless element, along with the method of manufacturing the swim cap with seamless element.

BACKGROUND OF THE RELATED ART

A number of shower and swim caps have been provided in the prior art, nevertheless, they differ from the present invention in that they do not teach a functional cap for wearing by a swimmer or bather, respectively, wherein the seamless element are rubber-like appendages or protrusions in a number of colors and style and a method of making the swim cap with this seamless element.

One such decorative cap does exist in the background art (Owen et al., U.S. Pat. No. 3,247,521), in which the composite cap invention permits a girl to wear a waterproof protective cap directly over her hair for keeping it dry while or showering, and permits her at the very same time to wear an attractive feminine headdress which give her the stylish appearance she likes on the beach or even in the water. However, Owen is distinguished from the present invention in that the decorative outer cap is made of frail fabric and stylized to appear as an ornate headdress. Moreover, Owen does not teach a cap with a seamless element, nor a method of manufacturing a cap with such an element. Accordingly, a need remains for a functional water cap with a superior watertight seal, comfortable to wear, and not to mention stylized and fashionable. The following embodiments of the present invention address this void by offering a swim and bath cap with a waterproof, rubber-like element that is seamlessly coextensive with the main cap portion.

Another decorative cap in the background art is by Bernhart Denmark (U.S. Pat. No. 3,163,866), which teaches a cap with a decorative element, such as flowers, made of polyethylene, fastened by a snap mechanism. This is distinguished from the present invention in that the main cap and decorative element are not one seamless, coextensive piece, and they require a snap mechanism to fasten the two separate pieces of the cap assembly.

Johnson, et al. (U.S. Pat. No. 6,966,068), describes and claims a swim cap, having a unitary construction and ear cover portions. The novelty rests in the stiffness gradient of the elastomeric material, ranging from maximum stiffness at the crown section, gradually decreasing in stiffness moving toward either side of the open edge. Johnson does not disclose, nor claim, a swim and bath cap, with an unitary construction of elastomeric main body cap with a seamless decorative element.

Vall (US 20090139004) and Smith (US 20080134405), respectively, teach a wig swim cap and a wig and bathing cap, which consists of a combination of wig and cap portion. These references differ from the present invention, in that they consist of a cap and wig portion that are two discontinuous pieces, wherein the wig element consists of wig material mimicking actual hair, and no rubberized silicone with functional characteristics. These references represent wigs that have certain, limited waterproof functionality, in contrast to the present invention, which represents a protective, functional water cap, featuring a seamless element that is coextensive with the main cap portion. One of many embodiments may include a seamless element, which mimics hair of varying styles and color, but is consistent in material with the main cap portion and is seamlessly extending from the main cap portion.

Additionally, the Smith wig and bathing cap has the added feature of having an outer cap layer and an inner cap layer, whereby the wig element with limited functionality is bonded with the outer surface, thereby distinguishing itself from the present invention. The present invention does not require bonding or heat seaming between various elements since it incorporates a mold injection process resulting in one coextensive, seamless piece between the main cap portion and protruding element.

In view of the foregoing void, a need has arisen for swim and bath caps to satisfy these needs. In particular, a need exists for swim and bath caps that are watertight, yet comfortable and stylish. The water-repellant headwear is used for a wide-range of reasons. It is not desirable or healthy to wash hair everyday or every time you shower or bathe; it is desirable to preserve a style after a salon visit or for special occasions; it is not comfortable or healthy to go to bed, outside in cool weather or just walk around with wet hair; it is desirable to protect hair while in a pool, at a spa or engaging in an activity that might affect or alter your hair. However, one of the most unattractive functional pieces of headgear we wear is a bathing or shower cap. The present invention solves this problem with a comfortable, watertight cap, which is seamlessly fabricated with a stylish decorative element.

SUMMARY

The embodiments of the present invention relate to a hair cap, and more specifically, the embodiments of the present invention relate to a stylish swim and bath cap for wearing by a swimmer or bather, respectively, having fun, stylish protrusions of various styles and color. The vanity element fabricated seamlessly and coextensively with the main portion cap, both of which are comprised from the same water-resistant material.

In general, in one aspect, the invention relates to a cap fabricated seamlessly with an element comprised of water-resistant strands of varying length, thickness, color, and texture to mimic hair, while maintaining the superior water-repellant features of the functional cap. All of the various embodiments, with varying decorative elements, would transform the latex, silicone and Lycra swim caps or elasticized plastic shower caps found in all households and sport facilities, into sexy, novel head coverings delivering a powerful style statement. More particularly, it is an object of these embodiments to provide a swim and bathing cap that isn't just relegated for women, but is also suitable for both men and children alike. After all, men and children enjoy showering and swimming as well, and may not want to wet their hair for many of the same reasons as women. What's more, men and children, likewise, may have a penchant for flair, while not willing to compromise on utility and comfort.

It is a further object to provide a new and improved swim and bath cap, comprising of a lightweight, durable construction, as well as a method of efficiently and economically manufacturing and marketing these stylish, durable, water-resistant caps. Durability and water-resistance are reinforced by way of the unique method of manufacturing of the cap with a seamless element, resulting in a main cap portion seamlessly coextensive with the decorative element. In yet another aspect of the invention, the mold material used in the mold injection process involves the use of UV-absorbing, cross-linking polymers, providing for additional durability in the face of prolonged UV exposure.

Still, another one of the objects is to provide a swim and bath cap that is so comfortable that the user forgets that they're even wearing a cap. The lightweight material, along with the contours of the cap, and edge lines, provide for unique comfort. The elastomeric band found in certain embodiments provides for additional comfort, especially along the brow and forehead region.

Various other objects, advantages, and features of the invention will become apparent to those skilled in the art from the following discussion, taken in conjunction with the accompanying drawings.

BRIEF DESCRIPTION OF THE DRAWINGS

FIG. 1 shows a perspective view according to aspects of the invention.

FIG. 2 shows an enlarged plan view according to aspects of the invention.

FIG. 4 shows a perspective view according to aspects of the invention.

FIG. 5 shows an enlarged plan view according to aspects of the invention.

DETAILED DESCRIPTION

Figure 3:
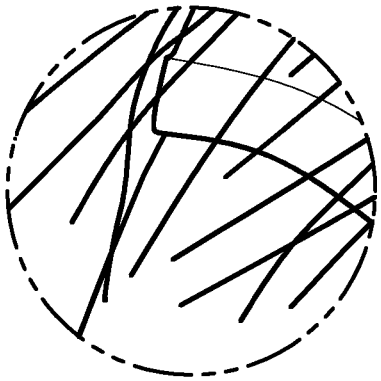
FIG. 3 shows a fragmentary enlarged sectional view according to aspects of the invention.

The following is a discussion and description of preferred specific embodiments of the swim and bath cap as claimed, such being made with reference to drawings, and in particular to FIGS. 1 to 8 thereof, whereupon the same reference numerals are used to indicate the same or similar parts and/or structure. Such discussion and description is to illustrate and not to unduly limit the scope of the invention.

Referring to the drawings in detail, and particularly to FIG. 1, the swim cap with a seamless element is shown in a perspective view. FIG. 1 shows one of many embodiments that have been conceived by the inventor. In its normal usage as a covering for the head of a female, male, child swimmer or bather, the user is assured of a comfortable, watertight seal, while not compromising ones fashion sensibilities.

As shown in FIG. 1, the seamless swim cap 102 includes a main body 104 with a dome-shape conformed to fit the shape of an average human head, providing ample housing or enclosure to fit hair of any size. From the crown 106 of this dome, the hypoallergenic, or non-hypoallergenic, elastomeric material composed of a lightweight, waterproof, elastic material, such as silicone, latex, lycra/spandex, rubber, neoprene, and polyurethane, projects downward to the opening perimeter, forming a perimeter edge 108 that frames the users face. The perimeter edge 108—with a front-edge section 110, right-side edge 112, left-side edge 114, and rear-edge section 116—is stretched around the user's head to form a water-tight seal, thereby keeping the users head completely dry during swimming or bathing. The cap is fitted by initially placing the rear edge 116 at the back of a user's head just below the hairline, and then stretching the cap around the sides and over the user's head with the front edge section 110 lying just below the user's hairline.

In the embodiment depicted in FIG. 1, the decorative element 118 is comprised of water-repellant strands, fashioned to mimic hair, and manufactured from the same material as the base of the cap, as one uninterrupted piece. The strands of the varying size, color, and style mimic varying hairstyle. This functional swim cap with any combination of black, blond, brown, red, etc. with fine, long, medium or short rubbery strands simulating hair has the unique characteristics of keeping one's hair dry comfortably, while making a fashion statement. The individual strands are to never be beyond a certain length, width, weight, so as to jeopardize or impair functionality. In a preferred embodiment, the length does not extend beyond the length of the wearers mid-neck in general, preferably ear-length, and the width and weight are generally consistent with commercially available fishing tackle. This material's water-resiliency and malleability make it the ideal for simulating hair and withstanding prolonged water exposure. As material for the main cap portion, seamless element, or both, the material delivers a superiorly water-resistant, soft-close fitting, and personal-adorning bath and swim cap. Other embodiments may include other material with similar properties, especially with respect to water-resiliency and malleability.

In another embodiment, the swim cap with a seamless element includes an ear-flap on both side edges, providing the wearer with the option to cover his/her ears during swimming and bathing by folding down the flaps, and conversely, to uncover the ears by folding up the flaps. Mounted on the outer surface of opposing side edges 112, 114 of the main body 104, are foldable, protective ear coverings 120 that are strategically positioned to safeguard against the inflow of water into the ear canal of a user. Once the flaps are down, they would form a watertight seal over the users ear, in much the same way the rest of the perimeter edge 108 does. The flap is comprised of the same material as the rest of the base cap and would be located on the side edge sections 112, 114, just above the ear area, and just below the decorative features, as illustrated in FIG. 2.

In yet another embodiment, the swim cap with a seamless element includes ergonomic ear pockets 146. These oversized, ear-shaped, convex features are positioned on both side edges. In this embodiment, users will have a firm, watertight seal over the ears, preventing any inflow of water into the ear canal. The slightly outward bulge of the ear pockets provide ample space for the swimmers ears, so it is not constrained by the tight seal of the perimeter edge 108. However, the bulge is designed ergonomically, so as to not compromise the hydrodynamics of a swimmer. A preferred bulge is 0.4 mm to 8 mm from the surface of the cap side edges, ideally 0.6 mm.

In a further embodiment, the swim cap with a seamless element is comprised of sheet material (lycra, latex, silicone, etc.) encompassing the base and the decorative feature, further comprising polymers that cross-link in the ultraviolet spectrum, thereby having more durability in the face of prolonged sunlight exposure. The use of a plasticized, thermoplastic film with a specific phosphate arrangement would be ideal. A preferred material is a plasticized polyvinyl chloride film of thickness between 100 and 300 microns. These resins are transparent to substantially all of the available energy in the UV-A and UV-B wavelengths and most of the visible and IR spectrum, but rather than degrading, the polymers cross-link under the absorption of energy at those wavelength intervals, and hence become stronger during prolonged exposure of sunlight. FIG. 3 and FIG. 4 illustrate this embodiment, as well as the preferred embodiments, with a fragmentary sectional view of the strands and a perspective of the mold-embodiment mounted, respectively. The strands or any of the decorative embodiments would visibly be the same, whether in the conventional preferred embodiments, or this UV-absorbing embodiment.

FIGS. 4 and 5 illustrate various views of the mold embodiment of the swim cap with a seamless element: mounted perspective view and mounted plan view, respectively. In this embodiment, instead of loose strands, the seamless element 118 comprises of a single, molded piece 122 fabricated into the cap as one uniform piece. This embodiment is to mimic the hair of a vintage male doll, or an antique female doll. The mold is comprised of the same material as the main body cap 104.

In still yet a further embodiment, the swim cap with a seamless element feature a novelty design element 148, which has the protrusions mimicking the dorsal appendages of fish and other animals, i.e. shark fins, etc. The protrusion in this particular embodiment is situated on the top medial portion of the main body 104 and are comprised from the same material as the main body cap 104, manufactured as one, uninterrupted piece. Other embodiments cover any and all other novelty design features which may be attractive to children, including, but not limited to, animated characters, copyrighted characters requiring licensing arrangements i.e., Disney-themed characters, etc., and printed graphics, etc. The novelty design element 148 is manufactured to be seamless and coextensive with the main body cap 104.

Figure 6:
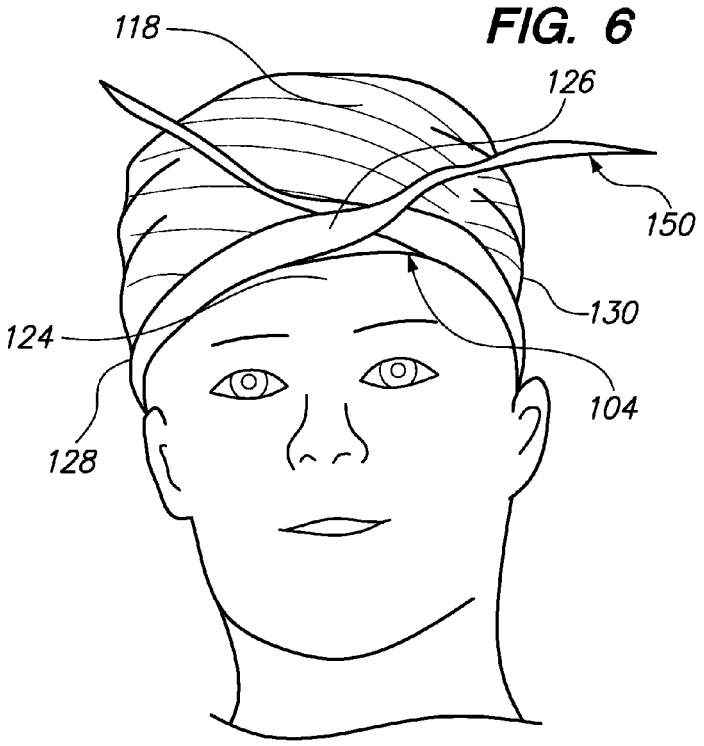
FIG. 6 shows a front view according to aspects of the invention.
Figure 7:
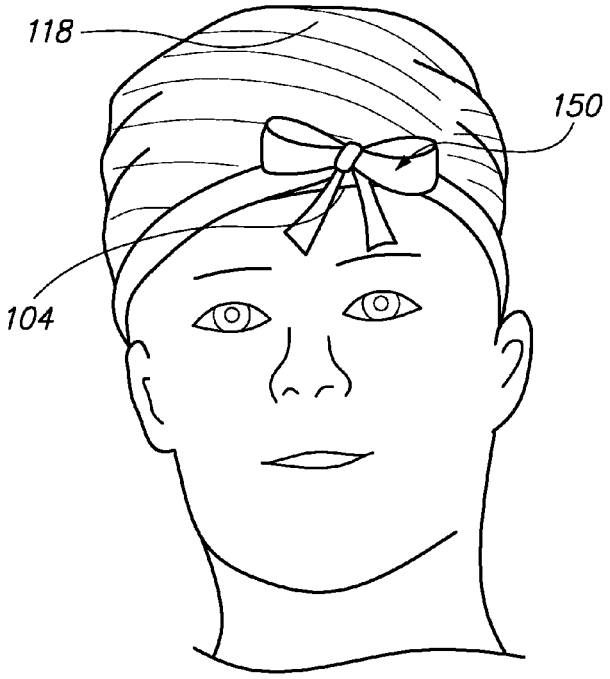
FIG. 7 shows a front view according to aspects of the invention.

FIGS. 6 and 7 illustrate various views of the mold embodiment of the bathing cap: mounted front view with an untied tie-string and mounted front view with a tied tie-string, respectively. In yet another embodiment, a bathing cap with an elasticized or drawstring band is described. The dome-shaped main body enclosure with a crown provides for ample housing to fit hair of any size. The crown projecting downward to the brim-edge 124 extending about the aperture—with a front-edge section 126, right-edge section 128, left-edge section 130, and a rear-edge section 132—framing the users face and forming a comfortable, water-tight seal during bathing and/or showering. The main body cap 104 and decorative element 118 of the bathing cap embodiment are manufactured as a single, continuous, molded piece, and may be comprised of the water-resistant material previously described, or lighter material, such as polyvinyl plastic. The tubular brim edge 124 may contain either an elasticized band 138 or a drawstring 140 that extends all along the brim edge 124 and extends through a hole 142 in the front or rear brim edge 132. The drawstring is drawn or un-drawn using a draw chord closure mechanism 144. Further embodiments include a tie-string 150 extending from the perimeter edge, whereby opposing ends of the tie-string are pulled and tied to form a secure seal over a users head during bathing or showering. These mechanisms allow the bathing cap embodiment to stretch over a users head of any size, forming a watertight seal for the bather. The decorative element 118 of the bathing cap embodiment may be longer in length than the swimming cap embodiments (longer than ear-length), since bathing is a less demanding application, not requiring the full spectrum of functionality required by the swimming cap embodiment.

In yet another embodiment, the swim cap with a seamless element 102 is comprised of two discontinuous pieces: a decorative element 118 and a main body cap 104 that are seamlessly coextensive using a novel method of manufacture. Using two discontinuous pieces affords the option of using a different type of elastomeric material for the decorative element 118, versus the base cap 104. In further embodiments, the decorative element may not need to be comprised of elastomeric material, and may be composed of any material that does not impair the water-resistance and comfort features of the base cap. The novel method of manufacturing the swim cap with a seamless element 102, comprised of discontinuous pieces, provides for the appearance of a swim cap with a decorative element 118 that is seamless and coextensive with the base cap 104.

And in a further embodiment, employees who are normally forced to wear a hair net (food and beverage sector employees) and protective caps in sterile environments (surgeons and technicians) can instead use the swim cap with a seamless element 102 as previously described. This particular embodiment may use lighter material, not be water-resistant, and have longer strands protruding from the cap. The embodiment intended for this particular application is the least demanding and requires the least functionality.

Figure 8:
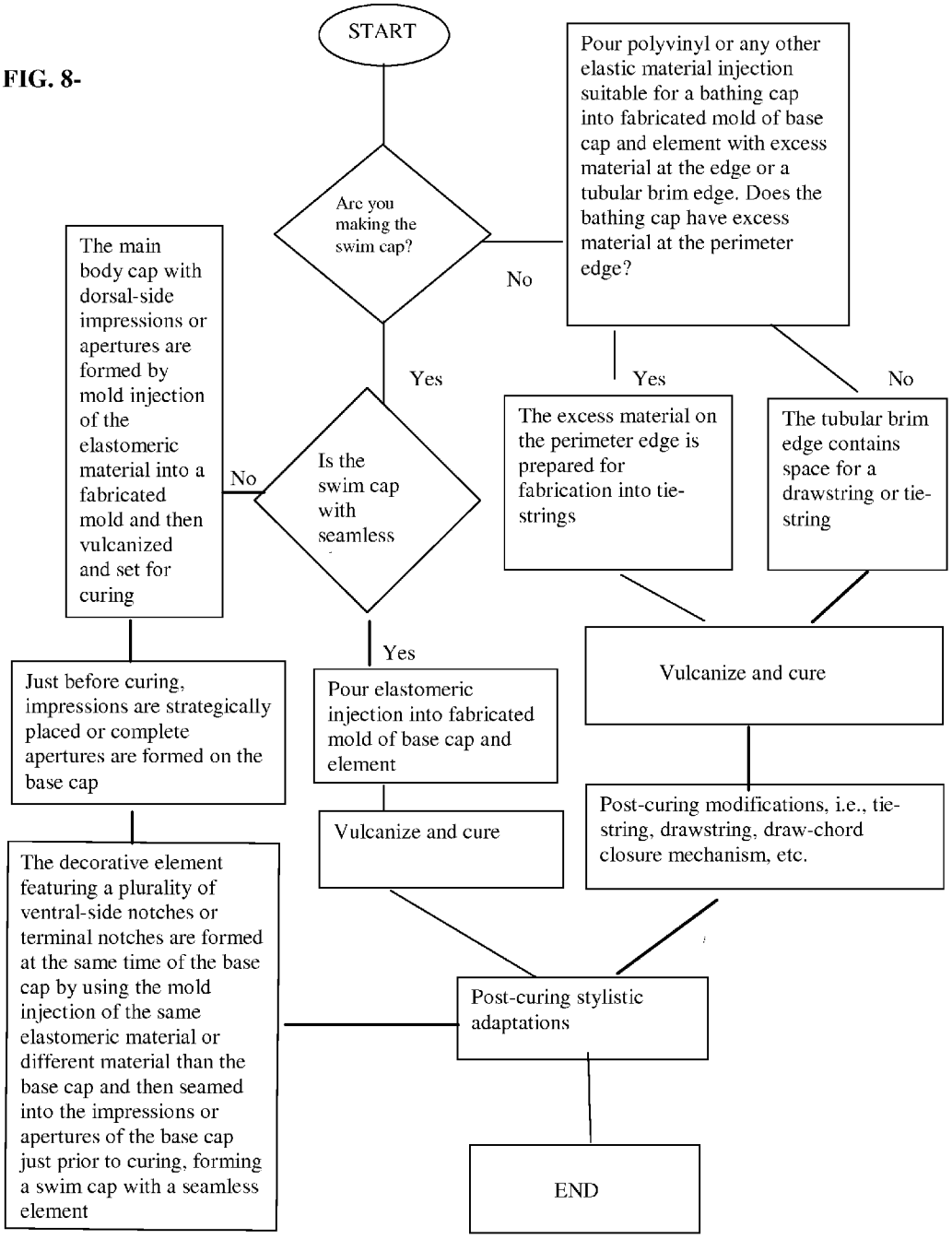
FIG. 8 shows a method flow chart according to aspects of the invention.

FIG. 8 depicts a flow chart describing the method of manufacturing the swim cap with a seamless element 102. A method of manufacturing the swim cap with a seamless element 102, as one continuous piece, comprising the steps of: forming the cap 104 by pouring the elastomeric mold injection of water resistant material into the fabricated mold; heat vulcanizing; curing; and adding color, print, and any other embossments. For the manufacturing of the swim cap with a seamless element 102, with two discontinuous pieces, the method comprises the steps of: forming the base cap portion 104 with dorsal impressions or apertures and a decorative element with terminal or ventral-side notches separately by pouring the elastomeric mold injection of water-resistant material into their respective fabricated molds; vulcanizing the base cap/decorative element and setting both pieces for curing; just prior to curing; the plurality of terminal notches or ventral-side notches of the decorative element 118 being seamed into the apertures or impressions of the base cap 104; and finally, the swim cap with a seamless element 102 comprised of discontinuous pieces has post-curing stylistic adaptations applied, i.e., embossments, etc. For the manufacturing of the shower and bath caps, an additional tubular brim edge 124 is constructed at the terminal edge, containing an elasticized band 138, tie-string 150, or a drawstring 140 with a draw chord closure system 144, for stretching and forming a tight seal during normal bathing or showering. Further embodiments include a tie-string 150 extending from the perimeter edge, whereby opposing ends of the tie-string 150 are pulled and tied to form a secure seal over a users head during bathing or showering.

The methods include the steps of: Using a polyvinyl or any other elastomeric injection into a fabricated mold for the construction of a cap with a seamless element 102 that includes a perimeter edge with excess material or a tubular brim edge 124; after vulcanizing and curing, the cap with element 102 are subject to post-curing modifications, i.e., inserting tie-strings 150 or drawstrings 140 with closure into the tubular brim edge 124 or fashioning the excess material into tie-strings 150; finally, applying post-curing and post-modification stylistic adaptations to the bath cap with a seamless element 102. In certain embodiments, ergonomic ear pockets 146 or foldable earflaps 120 are constructed on the right and left side edges. The ear-pockets 146 are over-sized to fit the ear of any size, and are in the general shape of human ear, rather than just a semi-circle or square. The earflaps 120, likewise, would be strategically placed, but would not be over-sized, simply because it will need to form a tight-water-tight seal, once the flaps are down.

In still a further embodiment, a more durable cap is manufactured that can withstand prolonged exposure of sun and ultra-violet rays, by incorporating UV-absorbing, cross-linking polymers into the water-resistant mold injection. The use of a plasticized, thermoplastic film with a specific phosphate arrangement would be ideal. A preferred material is a plasticized polyvinyl chloride film of thickness between 100 and 300 microns. These resins are transparent to substantially all of the available energy in the UV-A and UV-B wavelengths and most of the visible and IR spectrum, but rather than degrading, the polymers cross-link under the absorption of energy at those wavelength intervals, and hence become stronger during prolonged exposure of sunlight.

Therefore, the forgoing is considered as illustrative and descriptive of a number of embodiments covering the novel aspects of the swim cap with a seamless element, and it is not intended to be limited to the details shown, since various modifications and structural changes may be made without departing in any way from the spirit of the present invention.

The invention claimed is:

1. A water-resistant cap comprising:

a dome-shaped main body enclosure with a crown providing ample housing to fit hair of any size, said crown projecting downward to a perimeter edge extending about an aperture—with a front-edge section, right-edge section, left-edge section, and a rear-edge section—forming a water-tight seal during swimming or bathing;

a plurality of water-repellant strands, projecting from an outer-surface of the crown, said strands varying in size, color, and style, wherein said strands are seamless with the outer-surface of the crown, such that the said strands project from the crown to partially expose the crown, and fully expose a lower portion of the perimeter edge of the dome-shaped main body enclosure; and a pair of tie-strings extending from any one of the front-edge section or rear-edge section of the fully exposed lower portion of the perimeter edge, said tie-strings contiguous with the perimeter edge.

2. The water-resistant cap of claim 1, further comprising:

an ear-flap on both right and left side edges of the perimeter edge of the main body enclosure said flaps providing a user with the option to cover his or her ears during swimming or bathing by folding down the flaps, forming a water-tight seal over the ears in the same way as the remainder of the perimeter edge of the main body enclosure and conversely, providing the user the option to uncover the ears by folding up the flaps.

3. The water-resistant cap of claim 1, further comprising:

an ergonomic ear pocket on both the right and left side edges, and wherein said ergonomic ear pockets are out-dented or convex from the right and left side edges and dimensioned to house an ear.

4. The water-resistant cap of claim 1, wherein the crown of the main body enclosure further comprises:

a novelty design feature, said feature protruding on the top medial portion of the crown of the main body enclosure and wherein said novelty design feature include any one of, or combination of, caricatures, vanity elements, and printed graphics.

5. A water-resistant cap comprising:

a dome-shaped main body enclosure with a crown providing ample housing to fit hair of any size, said crown projecting downward to a perimeter edge extending about an aperture—with a front-edge section, right-edge section, left-edge section, and a rear-edge section—forming a water-tight seal during swimming or bathing;

at least one molded element contiguously projecting from an outer-surface of the crown, wherein the at least one molded element is seamless with the outer-surface of the crown, such that the at least one molded element project from the crown to cover the crown, and expose only a lower portion of the perimeter edge of the dome-shaped main body enclosure; and a pair of tie-strings extending from any one of the front-edge section or rear-edge section of the fully exposed lower portion of the perimeter edge, said tie-strings contiguous with the perimeter edge.

6. The water-resistant cap of claim 5, further comprising:

an ear-flap on both right and left side edges of the perimeter edge of the main body enclosure, said flaps providing a user with the option to cover his or her ears during swimming or bathing by folding down the flaps, forming a water-tight seal over the ears in the same way as the remainder of the perimeter edge of the main body enclosure, and conversely, providing the user the option to uncover the ears by folding up the flaps.

7. The water-resistant cap of claim 5, further comprising:

an ergonomic ear pocket on both the right and left side edges, and wherein said ergonomic ear pockets are out-dented or convex from the right and left side edges and dimensioned to house an ear.

8. The water-resistant cap of claim 5, wherein the at least one molded element contiguous with the crown of the main body enclosure further comprises: a novelty design feature, said feature protruding on the top medial portion of the at least one molded element; and wherein said novelty design feature include any one of, or combination of, caricatures, vanity elements, and, or printed graphics.

9. A water-resistant cap product-by-process produced by a method comprising:

forming a mold of a dome-shaped main body enclosure, a plurality of water-repellant strands projecting from an outer surface of only a crown of the dome-shaped main body enclosure, a pair of tie-strings extending from any one of a front-edge section or rear-edge section on an exposed perimeter edge;

using a mold injection of a water-resistant material;

heat vulcanizing the mold of the main body enclosure, plurality of water-repellant strands, and pair of tie-strings;

allowing the cap, plurality of water-repellant strands, and tie-strings to cure to form one contiguous piece; and adding color, print, and any other embossments.

10. A water-resistant cap product-by-process produced by a method comprising:

forming a mold of a dome-shaped main body enclosure, at least one molded element projecting from an outer surface of only a crown of the dome-shaped main body enclosure, a pair of tie-strings extending from any one of a front-edge section or rear-edge section on an exposed perimeter edge;

using a mold injection of a water-resistant material;

heat vulcanizing the mold of the main body enclosure, at least one molded element, and pair of tie-strings;

allowing the cap, at least one molded element, and tie-strings to cure to form one contiguous piece; and adding color, print, and any other embossments.

* * * * *